US006164028A

United States Patent [19]

Hughes

[11] Patent Number: 6,164,028

[45] Date of Patent: Dec. 26, 2000

[54] REINFORCED STEEL STUD STRUCTURE

[76] Inventor: John P. Hughes, 33228 W. 12 Mile Rd. Ste. 336, Farmington Hills, Mich. 48334

[21] Appl. No.: 09/192,469

[22] Filed: Nov. 16, 1998

[51] Int. Cl.[7] ..... E04C 1/00

[52] U.S. Cl. ..... 52/317; 52/653.1; 52/243; 52/731.5; 52/731.9; 52/733.3

[58] Field of Search ..... 52/317, 243, 481.1, 52/481.2, 653.1, 731.4, 731.5, 731.8, 731.9, 733.3, 506.07; 248/218.4, 219.1, 221.11

[56] References Cited

U.S. PATENT DOCUMENTS

| | | | |
|---|---|---|---|
| 3,066,774 | 12/1962 | Dahme | 52/731.9 |
| 3,083,794 | 4/1963 | Stovall, Jr. | 52/731.9 |
| 4,002,001 | 1/1977 | Uydess | 52/731.5 |
| 4,007,570 | 2/1977 | Hunter | 52/317 |
| 4,177,968 | 12/1979 | Chapman | 52/731.8 |
| 4,448,004 | 5/1984 | Thorsell | 52/481.2 |
| 4,658,556 | 4/1987 | Jenkins | 52/317 |
| 4,791,766 | 12/1988 | Egri, II | 52/317 |
| 4,916,877 | 4/1990 | Platt | 52/317 |
| 5,189,857 | 3/1993 | Herren et al. | 52/317 |
| 5,904,023 | 5/1999 | DiGirolamo | 52/481.1 |
| 5,930,968 | 8/1999 | Pullam | 52/481.1 |
| 5,953,876 | 9/1999 | Agar | 52/481.1 |
| 5,964,071 | 10/1999 | Sato | 52/317 |
| 6,003,274 | 12/1999 | Wycech | 52/733.3 |

*Primary Examiner*—Beth A. Stephan
*Assistant Examiner*—Dennis L. Dorsey
*Attorney, Agent, or Firm*—Charles W. Chandler

[57] ABSTRACT

A horizontal bridging member is mounted between a pair of metallic studs to prevent relative motion between the two studs.

8 Claims, 3 Drawing Sheets

REINFORCED STEEL STUD STRUCTURE

BACKGROUND OF THE INVENTION

This invention is related to a structural steel frame assembly, and more particularly to a bridging structure means for reinforcing vertical studs to prevent their twisting under a load.

Steel studs are commonly employed in residential building structures and typically are formed of 16 or 18 gage channel-shaped cold rolled steel. In some cases they may be as tall as 9 feet high with 16 inches between centers. A typical channel-shaped configuration may have a 6 inch web and 2 inch flanges. One of the problems with such studs is that they have a tendency to twist because of their height. For this reason it is desirable to provide a reinforcing structure between adjacent studs to prevent twisting.

SUMMARY OF THE INVENTION

The broad purpose of the present invention is to provide an improved bridging structure for maintaining the stability of upright steel studs. The preferred bridging structure comprises a horizontal steel, channel-shaped bridging member having its ends corresponding to the distance between adjacent studs. One end of the bridging member has a flat tongue that is received through a diamond-shaped opening in the stud. A pair of opposed slots form a neck connecting the tongue to the body of the bridging member. The tongue is inserted through the diamond shaped opening, turned about its longitudinal axis and then seated on a pair of converging edges at the bottom of the opening. The opposite channel-shaped end of a similarly shaped bridging member is seated on the tongue on the opposite side of the stud.

A sheet metal screw fastens the second bridging member to the tongue of the first bridging member. This process is continued along the row of studs. A second series of horizontal bridging members can be mounted in a parallel array above the first set of bridging members between the studs to form a reinforced structure.

Still further objects and advantages of the invention will become readily apparent to those skilled in the art to which the invention pertains upon reference to the following detailed description.

DESCRIPTION OF THE DRAWINGS

The description refers to the accompanying drawings in which like reference characters refer to like parts throughout the several views, and in which.

DESCRIPTION OF THE PREFERRED EMBODIMENT

Figure 1:
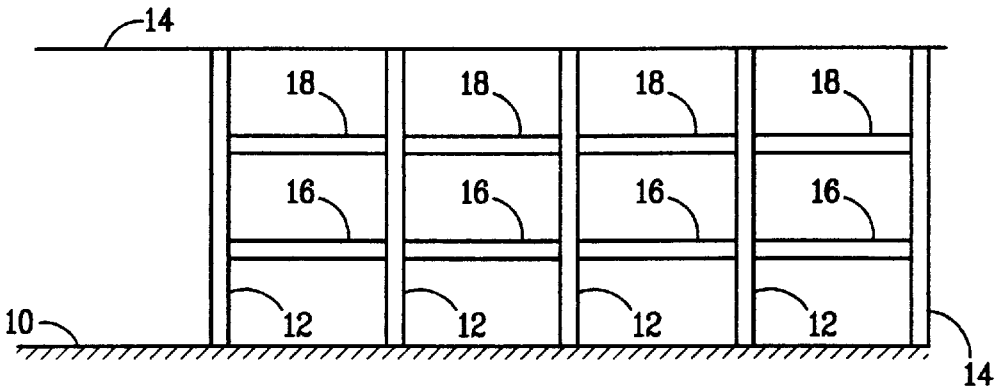
FIG. 1 illustrates a building wall having a series of parallel upright studs reinforced in accordance with the invention.

Referring to the drawings, FIG. 1 illustrates floor 10 supporting a steel framework comprising a series of five vertical studs 12 are mounted in an upright position on the floor to support an overhead structure 14. A pair of horizontal bridging members 16 and 18 are mounted between each pair of studs.

Figure 2:
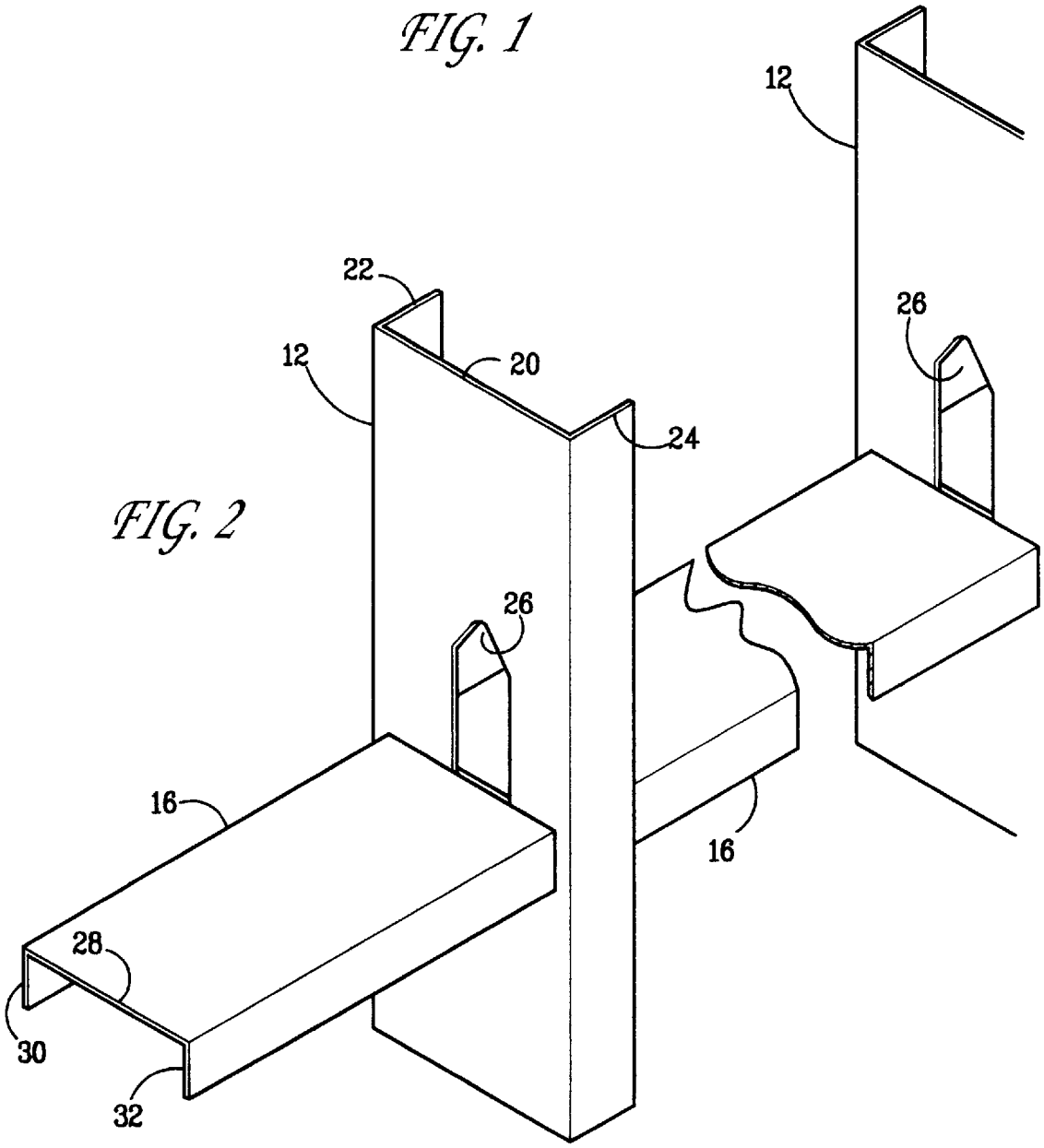
FIG. 2 is an enlarged perspective view of a typical intersection between a pair of bridging members and a stud.

The studs are similar in configuration, being formed of a steel sheet metal configuration with a planar mid section 20 as illustrated in FIG. 2 and a pair of parallel side walls 22 and 24.

Each bridging member is supported in a horizontal position in horizontally aligned openings 26 between each pair of studs. The bridging members are identical in cross section, and for illustrative purposes, have an overall length of 17 inches. Each bridging member is formed of sheet metal and bent with a planar mid section 28, and a pair of depending parallel flanges 30 and 32 as illustrated in FIG. 2.

Figure 3:
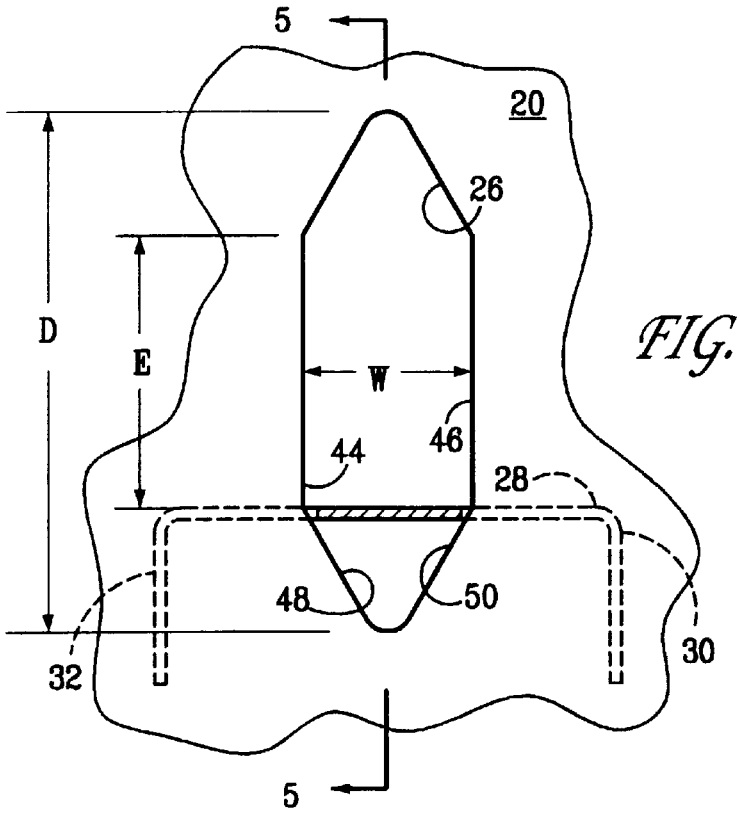
FIG. 3 is a view as seen along lines 3—3 of FIG. 5.
Figure 4:
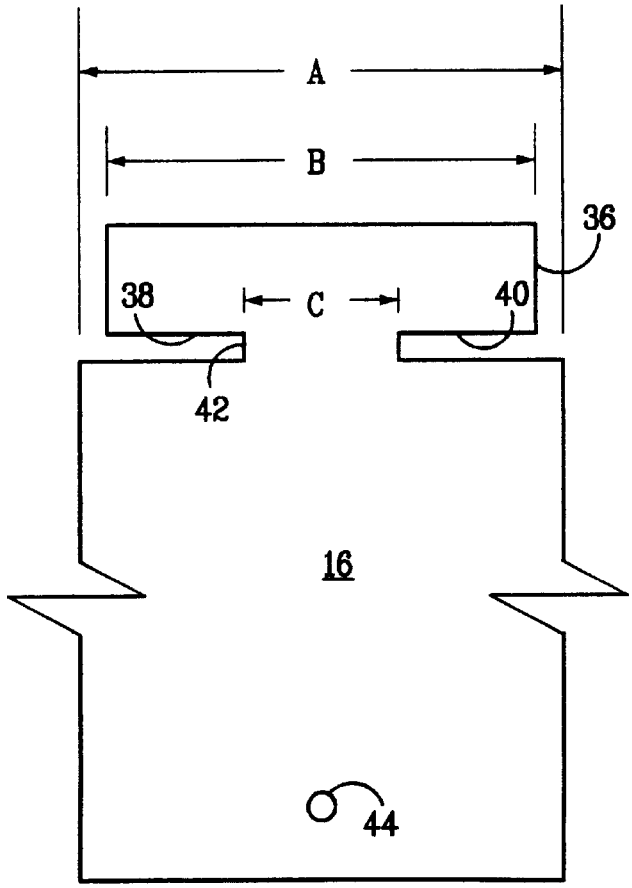
FIG. 4 is a plan view of the tongue end of a typical bridging member.
Figure 5:
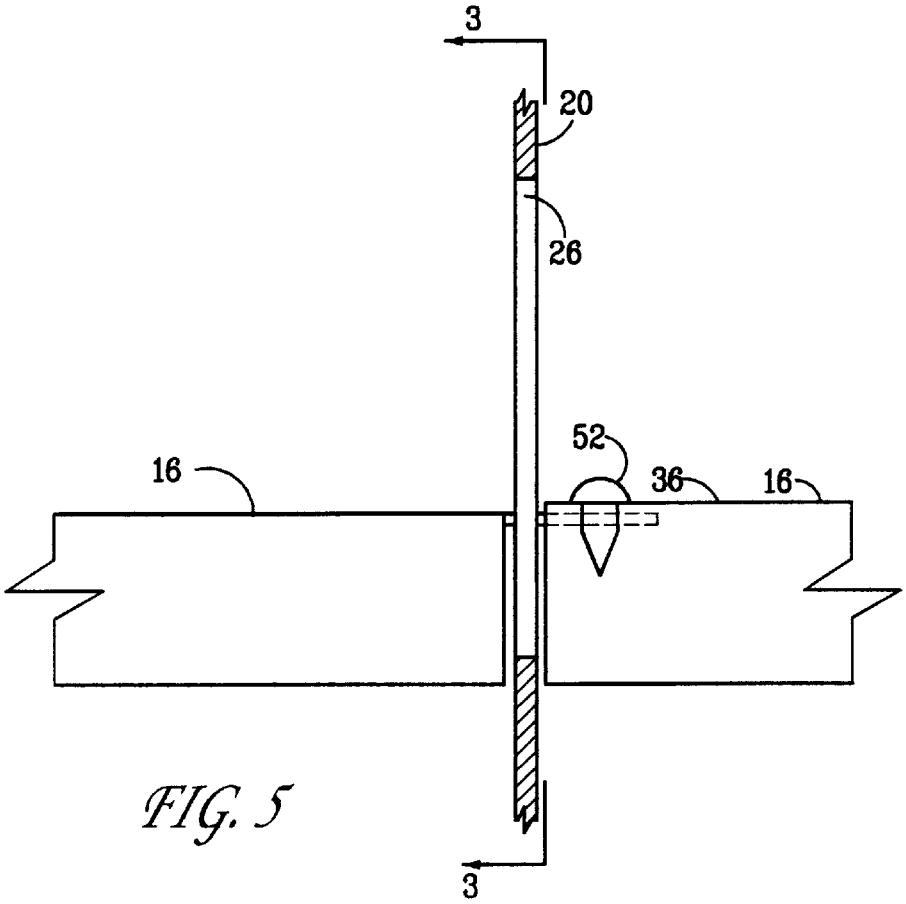
FIG. 5 is a view as seen along lines 5—5 of FIG. 3.

Referring to FIGS. 3 and 4, a typical bridging member has a width A of 4⅛ inches. The flanges are 1⅜ inches high. One end of each bridging member is cut off perpendicular to mid section 28, as illustrated in FIG. 5. The opposite end has a flat tongue 36 that extends from the planar mid section of the bridging member. The flat tongue has a width B of 3⅝ inches. A pair of opposed slots 38 and 40 form a neck 42 which connects the body of the bridging member to tongue 36. Neck 32 preferably has a width C of 1⅜ inches. The slots are about ⅛ inch wide which is slightly larger than the wall thickness of the stud. The tongue extends forwardly from the slots about ⅞ of an inch. A fastener opening 44 is disposed in the mid section of the bridging member at the opposite end from the tongue.

Referring to FIG. 3, a typical bridge-receiving opening 26 in the mid section of the stud has a generally diamond-shaped configuration with a height D of about 4½ inches. The opening has a width W of 1⁷⁄₁₆ inches and a generally V-shaped bottom. The mid section of the opening has a length E of 2⅛ inches. The mid section is defined by a pair of parallel side edges 44 and 46 which terminate in a V-shaped bottom defined by a pair of opposed side edges 48 and 50. The V-shaped side edges wedge neck 42 of the bridging member in a horizontal position.

Referring to FIGS. 2 and 5, left bridging member 16 is shown with its tongue 36 extended through opening 26 and wedged in the V-shaped bottom. The right-most bridging member is shown with its left channel-shaped end seated on top of tongue 36 of the left bridging member.

A sheet metal screw 52 firmly attaches the tongue of the left bridging member to the channel-shaped end of the right bridging member, as viewed in FIG. 5. This bridging procedure can be continued for a series of studs. In addition, a series of bridging members can be mounted one above the other in appropriately shaped openings in the studs.

It is to be understood that opening 26 can take a variety of configurations however, preferably it has a height that is greater than the width of the tongue so that the tongue can be inserted through the opening, and then the bridging member turned about its axis and slid downwardly until the neck of the bridging member is firmly seated on the edges of the upper end of the V-shaped bottom.

Figure 6:
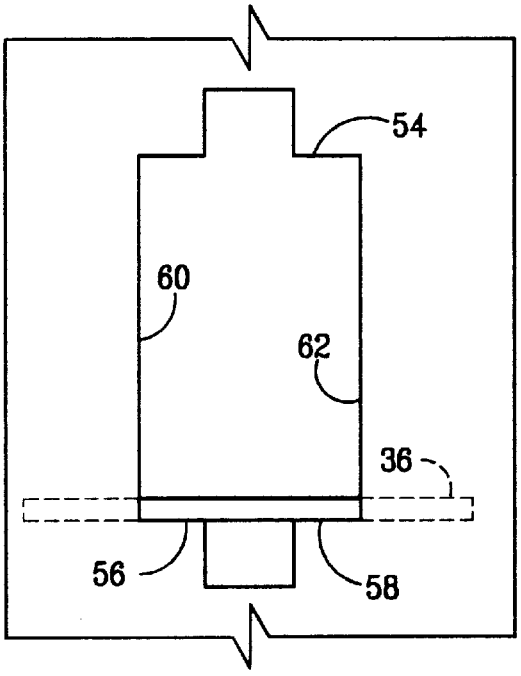
FIGS. 6 and 7 show other alternative stud openings for receiving a bridging member.

FIG. 6 illustrates an alternative bridge-receiving opening 54 showing the tongue seated on a pair of aligned, spaced edges 56 and 58 between side edges 60 and 62.

Figure 7:
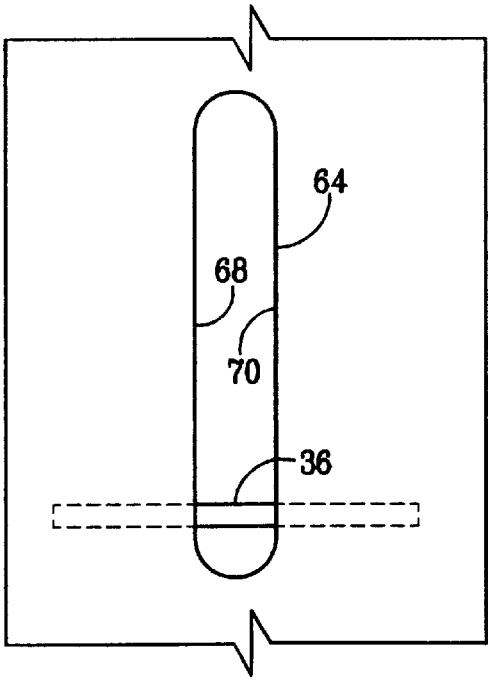

FIG. 7 illustrates another bridge-receiving opening 64 having a rounded bottom edge 66 for wedging the tongue between the side edges of the opening 68 and 70.

Having described my invention, I claim:

1. A building structure, comprising:

a first elongated structural stud having a planar section;

a second elongated structural stud having a planar section parallel to and spaced from the planar section of the first stud, each of the planar sections having a tongue-receiving opening aligned along an axis generally perpendicular to the planar sections;

an elongated first metallic bridging member disposed at right angles to the planar sections of the first and second studs;

said first bridging member having a channel-shaped body with a planar midsection and a first end, disposed entirely on one side of the planar section of the first stud;

said first bridging member having a second end abutting the planar section of the second stud on one side of the tongue-receiving opening therein, the second end of the first bridging member having a planar tongue extending from the first bridging member, and disposed on the opposite side of the tongue-receiving opening of the second stud;

a neck integrally connecting the mid-section of the first bridging member to the tongue thereof, the neck having a pair of spaced side edges, and a width less than the width of the tongue;

the tongue-receiving opening in the second stud having spaced edges for wedging the neck in the tongue-receiving opening of the second stud;

a similarly-shaped second bridging member having a neck wedged in the tongue-receiving opening of the first stud;

the second bridging member having a tongue overlapping the planar midsection of the first bridging member; and a fastener element connecting the tongue of the second bridging member to the overlapping midsection of the first bridging member, whereby the first stud is supported against movement with respect to the second stud.

2. A bridging structure as defined in claim 1, in which the fastener element is a threaded fastener.

3. A structure as defined in claim 1, in which each of said tongue-receiving openings in the structural members is elongated and has a length greater than the width of the tongue of said bridging member, and each of said tongue-receiving openings, has a greater width than the distance between said spaced edges whereby the tongue can be inserted into the tongue-receiving opening and the bridging member rotated until the neck is disposed on opposed edges of the tongue-receiving openings.

4. A structure as defined in claim 3, in which the tongue-receiving opening has a V-shaped configuration defining said opposed edges.

5. A structure as defined in claim 1, in which the body of the bridging member, the neck and the tongue are formed of an integral sheet metal structure.

6. A structure as defined in claim 1, in which the elongated structural members are disposed in upright spaced parallel positions, and the bridging member is disposed in a horizontal position between the structural members.

7. A structure as defined in claim 1, in which the tongue-receiving opening has a diamond shaped configuration with a V-shaped bottom.

8. A metallic bridging structure for preventing relative horizontal or twisting motion between a pair of metallic vertical building studs disposed a predetermined distance apart and having a pair of horizontally aligned tongue-receiving openings therein; comprising:

at least a pair of similarly-shaped bridging members including a first channel-shaped bridging member and a second channel-shaped bridging member each of the bridging members having a reduced section forming a neck and a tongue;

the first bridging member having the neck thereof capable of being wedged in the tongue-receiving opening of the first stud, such that the tongue thereof extends from the first stud toward the second stud;

the second bridging member having a first end with a planar midsection disposable in overlapping relationship with respect to the tongue of the first bridging member;

the second bridging member having a second end capable of being wedged in the tongue-receiving opening of the second stud;

means for fastening the midsection of the second bridging member to the tongue of the first bridging member in a position between the first stud and the second stud; and whereby the first and second bridging members cooperate to form a horizontal support between the first stud and the second stud.

* * * * *